US005455609A

United States Patent [19]

Gast et al.

[11] Patent Number: 5,455,609

[45] Date of Patent: Oct. 3, 1995

[54] PRINTHEAD SERVICING STATION FOR PRINTERS

[75] Inventors: Paul D. Gast; Alan Shibata, both of Vancouver; James O. Beehler, Brush Prairie; Thomas A. Pearo, Vancouver, all of Wash.

[73] Assignee: Hewlett-Packard Company, Palo Alto, Calif.

[21] Appl. No.: 954,846

[22] Filed: Sep. 30, 1992

[51] Int. Cl.[6] ..... B41J 2/165

[52] U.S. Cl. ..... 347/32; 400/701; 400/692; 192/143; 74/89.17

[58] Field of Search ..... 74/89.14, 89.17; 192/143; 400/322, 328, 701, 702, 702.1, 185, 692; 347/22, 32, 33, 29, 30, 37

[56] References Cited

U.S. PATENT DOCUMENTS

| | | | |
|---|---|---|---|
| 2,028,747 | 1/1936 | Horton et al. | 400/322 |
| 2,230,706 | 2/1941 | Torbelson | 400/322 |
| 4,437,105 | 3/1984 | Mrazek et al. | 346/140 R |
| 4,511,190 | 4/1985 | Hara | 346/140 R |
| 4,619,151 | 10/1986 | Trachman et al. | 74/89.17 |
| 4,684,963 | 8/1987 | Naka | 346/140 R |
| 4,709,246 | 11/1987 | Piatt et al. | 346/140 R |
| 4,825,231 | 4/1989 | Nozaki | 347/32 |
| 4,853,717 | 8/1989 | Harmon et al. | 346/140 R |
| 5,000,594 | 3/1991 | Beehler et al. | 400/569 |
| 5,027,134 | 6/1991 | Harmon et al. | 346/140 R |
| 5,146,243 | 9/1992 | English et al. | 346/140 R |
| 5,151,715 | 7/1992 | Ward et al. | 346/140 R |
| 5,155,497 | 10/1992 | Martin et al. | 347/33 |
| 5,216,449 | 6/1993 | English | 346/140 R |

FOREIGN PATENT DOCUMENTS

| | | | |
|---|---|---|---|
| 217255 | 8/1990 | Japan | 400/701 |
| 281255 | 12/1991 | Japan | 347/32 |
| 77263 | 3/1992 | Japan | 400/701 |
| 115953 | 4/1992 | Japan | 400/701 |
| 219251 | 8/1992 | Japan | 347/33 |
| 1514719 | 10/1989 | U.S.S.R. | 74/89.17 |

OTHER PUBLICATIONS

*Hewlett Packard Journal,* Integrating the Printhead into the HP Deskjet Printer by J. Paul Harmon and John A. Widder, pp. 62–66, Oct. 1988.

*Hewlett Packard Journal,* DeskJet Printer Chassis and Mechanism Design by Larry A. Jackson, Kieran B. Kelly, David W. Pinkernell, Steve O. Rasmussen, and John A. Widder, pp. 67–75, Oct. 1988.

"Desk Writer C" product.

*Primary Examiner*—David A. Wiecking

[57] ABSTRACT

Methogology and apparatus are described which employ an improved modular service station design wherein a printhead-servicing sled is selectively vertically driven to effect execution of servicing tasks. In keeping with its desired modularity, the sled is made readily removable using an improved clamp and sled arrangement. The sled is driven by a unique drive system such drive system being capable of effectively selectively stalling or locking instrumentality such as the sled in various positions defined along its path of vertical movement. To save time and space, both the printhead and the servicing mechanism such as the wipers and the caps are moved so as to place them in proper relative positions for execution of a task. Precise relative positions of the servicing mechanism and the printhead are achieved and maintained during the course of a servicing task such as printhead capping by employment of an improved printhead registration system which limits relative rotation between the printhead and the servicing mechanism.

28 Claims, 9 Drawing Sheets

PRINTHEAD SERVICING STATION FOR PRINTERS

TECHNICAL FIELD

The present invention relates generally to method and apparatus which provide low-cost solutions to problems related to the alignment, replacement and transport of instrumentality. Such methodology and apparatus has proven particularly useful in applications related to the servicing of a printhead in a printer and is generally described as such herein.

BACKGROUND ART

In a conventional printer, printhead servicing is accomplished by moving the printer's printhead to a predetermined servicing position, sliding the servicing mechanism to a predetermined point of interface, and performing the desired servicing task. The servicing mechanism generally forms a part of a service station, the service station being housed in the printer's chassis so as to shield the station from inadvertent harm. In order to bring the servicing mechanism into interface with the printhead, it is conventional to act on the station using a carriage which moves the printhead into its servicing position. Such carriage generally acts on the station by cammed engagement therewith moving the servicing mechanism into the desired interface position. By virtue of the carriage's engagement with the service station, the servicing mechanism is selectively locked or held in place during operation of the serving task. After the servicing task is performed, the printhead carriage disengages the station and the servicing mechanism is allowed to fall back into its initial position.

Although relatively simple, and thus inexpensive, the just-described arrangement has been characterized by less than accurate alignment between the servicing mechanism and the to-be-serviced printhead. Such inaccuracies are due in large part to the method of service station transport, but are also related to the manner in which the servicing mechanism is locked or held in place during operation of the servicing task. Known arrangements, for example, have failed to provide for adequate registration of the service station, generally allowing movement in all but one of the six degrees of linear and rotational freedom. This movement, in turn, has led to ineffective capping of printheads, a servicing task which is commonly performed in ink-jet printers, printers in which wet-ink printheads (pens) are employed.

Another area in which known servicing arrangements have left room for improvement is in the area of service station adaptability and replaceability, features which accommodate use of a single printer chassis and/or service station in different printer applications. It may, for example, be desirable to provide a chassis or service station which accommodates service of various printhead configurations (e.g. for single- or plural-printhead applications). Such adaptability would likely lead to lower manufacturing and design costs, and thus to a lower end-user purchase price. Despite the foreseeable benefits, known printers do not adequately provide for the adaptation or replacement of printhead service stations. Prior art printers have instead employed service stations which are manufactured as an integral part of the printer's chassis, and are thus not suitable for easy substitution where an alternative printer application is desired.

DISCLOSURE OF THE INVENTION

The invented method and apparatus address the above-identified problems by providing a service station of improved modular design. The improved service station is made easily removable from a printer by containing the service station in a framework which forms a part thereof. The framework, which is selectively secured to the printer's chassis, is removable in a manner which accommodates removal of the service station as a whole.

The service station, in keeping with its desired modularity, includes a removable sled which selectively is driven vertically into a servicing elevation to effect servicing of the printer's printhead. Servicing is effected using servicing mechanism such as a printhead wiper or a printhead cap, either of which is mounted on the sled so that it may be selectively changed along with the sled. The sled is driven by a unique drive system which, in the preferred embodiment, forms a part of the improved service station. The drive system is capable of effectively locking instrumentality such as the sled and the servicing mechanism in positions predefined relative to reference structure such as the printer's chassis.

The drive system is made up generally of a instrumentality-carrying rack, a rotating pinion, and a worm gear, such components being configured in an arrangement so as to effect locking of the instrumentality upon corresponding lock-up of the worm gear. The rack, which is coupled to the pinion gear, is selectively moved relative to the reference structure in a first direction along a predetermined path, such movement being limited selectively by a movable stop. Limiting action is effected by selected placement of the stop in a first position wherein the stop is engaged upon movement of the rack so as to build up torque in the driving pinion gear. The stop, however, is controllably movable to a position wherein the pinion gear torque is alleviated, allowing the rack, and thus the instrumentality carried thereby, to continue in the first direction along the predetermined path.

Because of the various adaptations which are possible in the presently improved modular service station design, it is generally necessary, before a printhead is serviced, to identify the desired servicing task. Once this is done, it is further necessary to determine what relative positions of the printhead and the sled are necessary in order to accomplish the task. The printhead is then moved to the proper servicing position and the task is executed.

It is, on occasion, important to ensure that precise relative positions of the servicing mechanism and the printhead are achieved and maintained during the course of a servicing task such as printhead capping. For this reason, the improved service station which is herein disclosed utilizes a registration system which limits relative rotation between the printhead and the servicing mechanism about an axis which corresponds to the direction of relative approach. This is accomplished by providing the printhead carriage with a plurality of spaced detents and providing the service station's sled (to which the servicing mechanism is fixed) with a plurality of correspondingly spaced posts.

The sled is generally held by a clamping member, which in turn is secured to the rack so that sled movement may be effected. To remove the sled from the clamping member, the printer's operator simply effects pinching action against a projection which extends angularly upward from the sled's base. The projection is pinched relative to a finger which extends upwardly from the clamp, such action, when the clamp and sled are combined, pushing the sled against a resilient member to cause upward biased sled release. A tight, no-slop, releasable coupling of the sled (and thus the servicing mechanism) to the clamp is thus provided.

These and other objects and advantages of the present invention will be understood more readily upon considering the drawings and the detailed description of the preferred embodiment which is set forth below.

DETAILED DESCRIPTION AND BEST MODE FOR CARRYING OUT THE INVENTION

Figure 1:
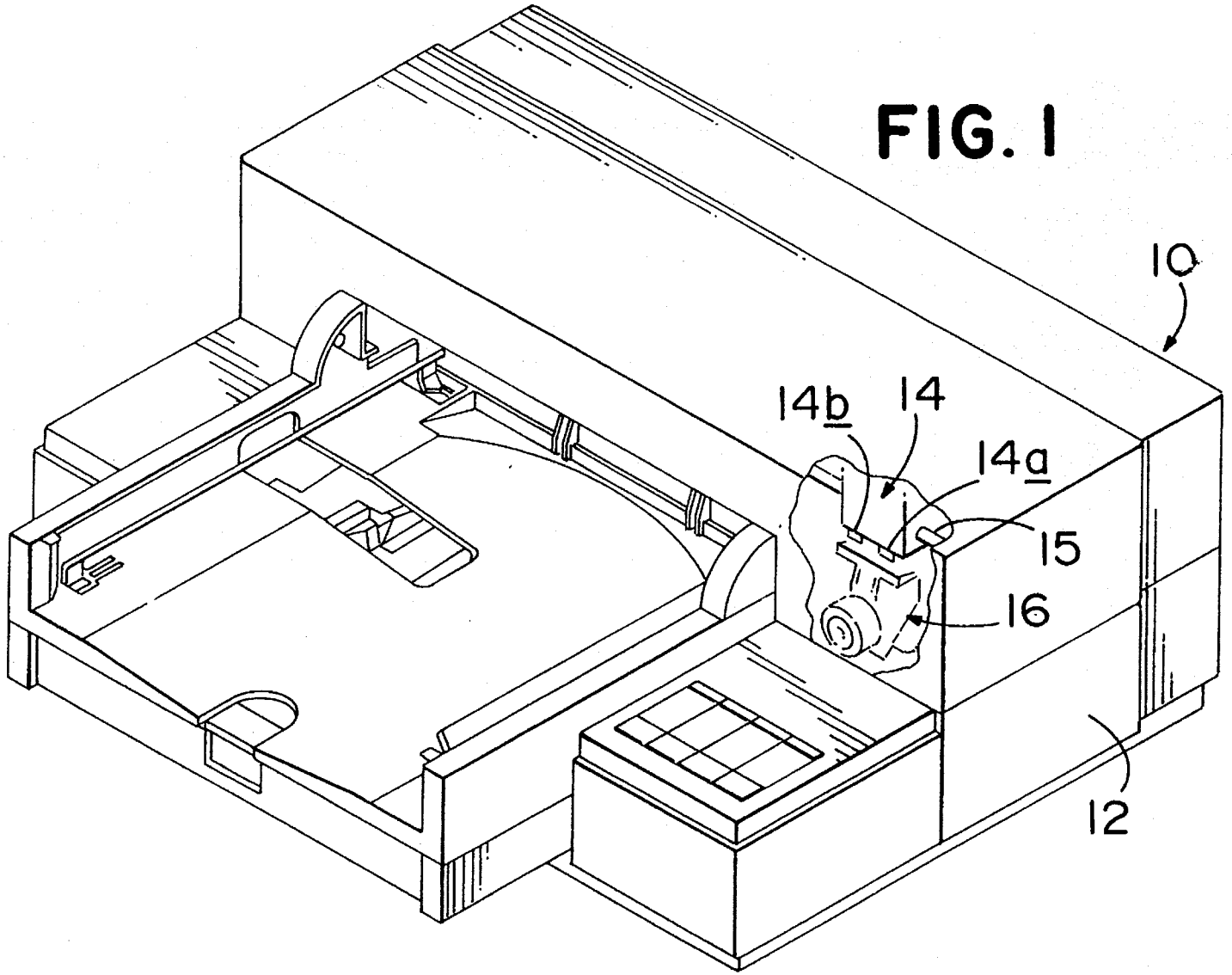
FIG. 1 is an isometric view of a printer, such printer employing a printhead service station of the type described herein.

Beginning with a general overview of the invention, and referring initially to FIG. 1, attention is drawn to the fact that the invented method and apparatus are suitable for use in an ink-jet printer 10 of somewhat conventional design. It is to be appreciated, however, that such method and apparatus may similarly be utilized in other style printers such as driven-pen printers, dot-matrix printers, or other somewhat dissimilar devices. Despite its adaptability, however, the method and apparatus are described herein specifically in the context of a ink-jet printer, a printer in which they have proven particularly useful.

As shown, printer 10 includes a chassis 12, such chassis defining a reference structure relative to which various instrumentality is moved as will be further described below. The depicted printer also includes (as is exposed in simplified form by partial break-away of its chassis) a reciprocating carriage 14 which holds a pair of printheads 14*a*, 14*b*. In the embodiment shown in FIG. 1, printhead 14*a* is a monochrome (black) pen and printhead 14*b* is a tricolor (cyan, magenta, yellow) pen. During a print operation, the carriage reciprocates horizontally within the printer's chassis along a carriage shaft 15 with the printheads controllably depositing ink on print media which passes thereacross. Although printer 10 is fitted with a plural-printhead carriage in FIG. 1, those skilled in the art will recognize that the printer may be modified by a relatively simple operation to employ a single-printhead carriage. In either case, the printhead(s) will require periodic servicing by mechanism such as that included in the improved service station which is shown in generally simplified form at 16.

In a conventional ink-jet printer such as printer 10, printheads are serviced through the operation of various servicing tasks such tasks generally being necessary to maintain printhead viability. One such servicing task relates to the periodic wiping of printheads, a task which is described generally in a corresponding U.S. patent application entitled "Synchronized Carriage and Wiper Motion Method and Apparatus for Ink-jet Printers" naming Gast et al. as inventors and which is commonly owned herewith. Another servicing task concerns printhead capping, an example of such operation having been provided in U.S. Pat. No. 5,027,134 entitled "Non-Clogging Cap and Service Station for Ink-jet Printers", which issued Jun. 25, 1991 and which is also commonly owned herewith. Although both tasks are important, and both tasks are performed by the improved service station which is herein described, the capping task is chosen as the primary example by which to explain the apparatus and methodology which form the present invention.

To effect servicing of the printer's printhead, it is desired to employ a newly developed printhead-servicing method which enables the printer economically to execute tasks such as those referenced above. Such method, it will be appreciated, is most useful in effecting proper printhead capping, particularly where capping is to be effected in a printer which may be modified to employ either a single- or a plural-printhead carriage. Different carriage configurations have in the past necessitated correspondingly different cap configurations and thus have made printhead capping an unnecessarily complex task. Printhead capping, however, may be simplified in view of the fact that only three carriage configurations are .commonly used. Such configurations accommodate the use of: (1) a single monochrome printhead; (2) a single tricolor printhead; or (3) both a monochrome printhead and a tri-color printhead. Printheads employed in any of these configurations may be capped using the same service station arrangement (described further below) by exercising control over the carriage when the capping task is to be executed. Similarly, printhead wiping may controllably be effected by synchronous action of the carriage with the wipers without altering service station design or configuration.

Consequently, printhead service is accomplished in printer 10 using a method which begins with identifying the desired servicing task (e.g. capping both monochrome and tri-color printheads). Once the task is identified, a determination is made as to where the printhead(s) should be positioned during execution of the task and the carriage is moved so as to place the printhead(s) in such position(s). At this point, the task may be executed. In order to effect such operation automatically, carriage movement is preferably controlled by a processor such as a microprocessor of the type generally employed in printers of conventional design. The processor is generally supplied with information concerning the carriage configuration employed and with information which allows the processor to determine where the printhead should be positioned during the upcoming printhead-servicing task.

Figure 2:
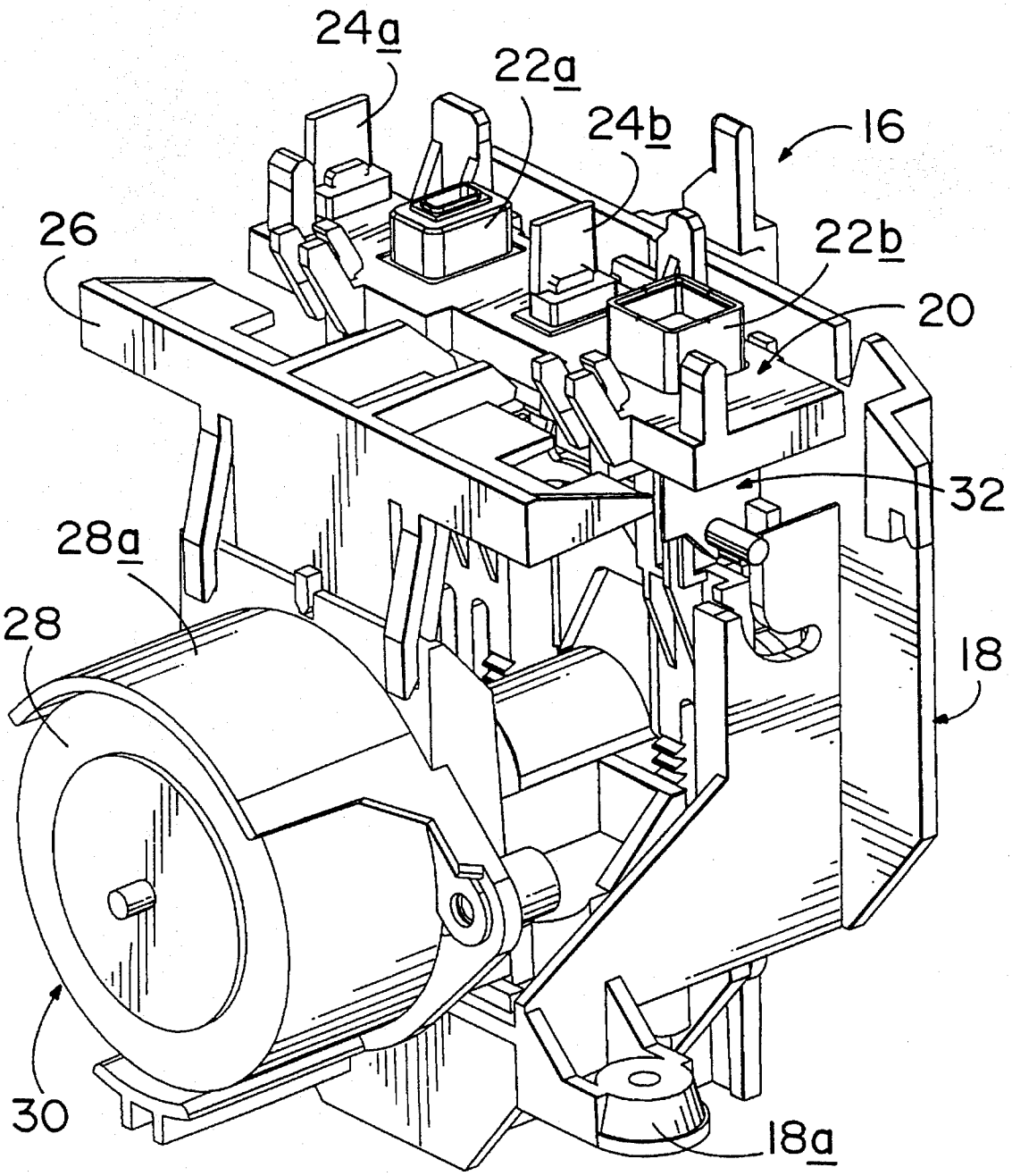
FIG. 2 is an enlarged isometric view of the improved service station, the service station being shown in isolation.

Turning now to a more Specific description of the improved service station, and referring initially for this purpose to FIG. 2, the reader is provided with an isometric illustration of service station 16, such apparatus being shown independent of the printer. As indicated, the service station includes a framework 18, such framework effectively containing the service station so as to accommodate removal and replacement of the service station as a whole. The framework is configured for selected rigid securement to the printer's chassis, such flamework including a pair of horizontally projecting hold-down mounts, one of which is shown at 18*a* in FIG. 2.

The hold-down mounts, it will be understood, accommodate securement of the service station to bosses on the chassis' floor, such securement being achieved via suitable securement means such as screws (not shown). In the preferred embodiment, the hold-down mounts extend from adjacent opposite corners of the flamework and the flamework conforms to interior structure of the chassis so as to ensure a stable service-station/chassis combination. The flamework is thus designed to provide a unique modular printer organization while, at the same time, maintaining rigid positional control of features critical to service station operation as will be understood upon further reading.

Referring still to FIG. 2, but focusing further on the features which effect servicing of printheads, it will be appreciated that the depicted service station includes a printhead-servicing sled 20 such sled being movable relative to the station's flamework (and thus the printer's chassis) to effect servicing of the printer's printheads. The sled, it will be noted, carries various instrumentality, including printhead-servicing mechanism such as caps 22*a*, 22*b* and wipers 24*a*, 24*b*. Such servicing mechanism, as suggested by the relevant nomenclature, is useful in either wiping the printer's printheads (using wipers 24*a*, 24*b*), or capping the printer's printheads (using caps 22*a*, 22*b*), as generally described in the commonly owned invention disclosures referenced above. Those skilled in the art, for example, will understand that cap 22*a* is configured to effect capping of monochrome printhead 14*b* (see FIG. 1) and that cap 22*b* is configured to effect proper capping of a tri-color printhead 14*a* (see FIG. 1). The caps are mounted on the sled in positions which are known to the printer's processor so that proper carriage positioning may be achieved when any one of the above-identified carriage configurations is employed.

To save space within the printer's chassis, the improved service station provides for the servicing of printheads by vertically driven movement of the printhead-servicing sled. Such sled movement, it will be understood, results in movement of the printhead-servicing mechanism therewith. Servicing tasks are performed as the sled moves into one of several servicing elevations. Conventionally, sled movement into one of such servicing elevations effects capping or wiping of a printhead, but sled movement may also be effective to scrape the service station's wipers using a scraper such as that shown at 26 in FIG. 2. In the preferred embodiment, sled movement is processor-directed, allowing for precise adjustment of the sled.

Figure 3:
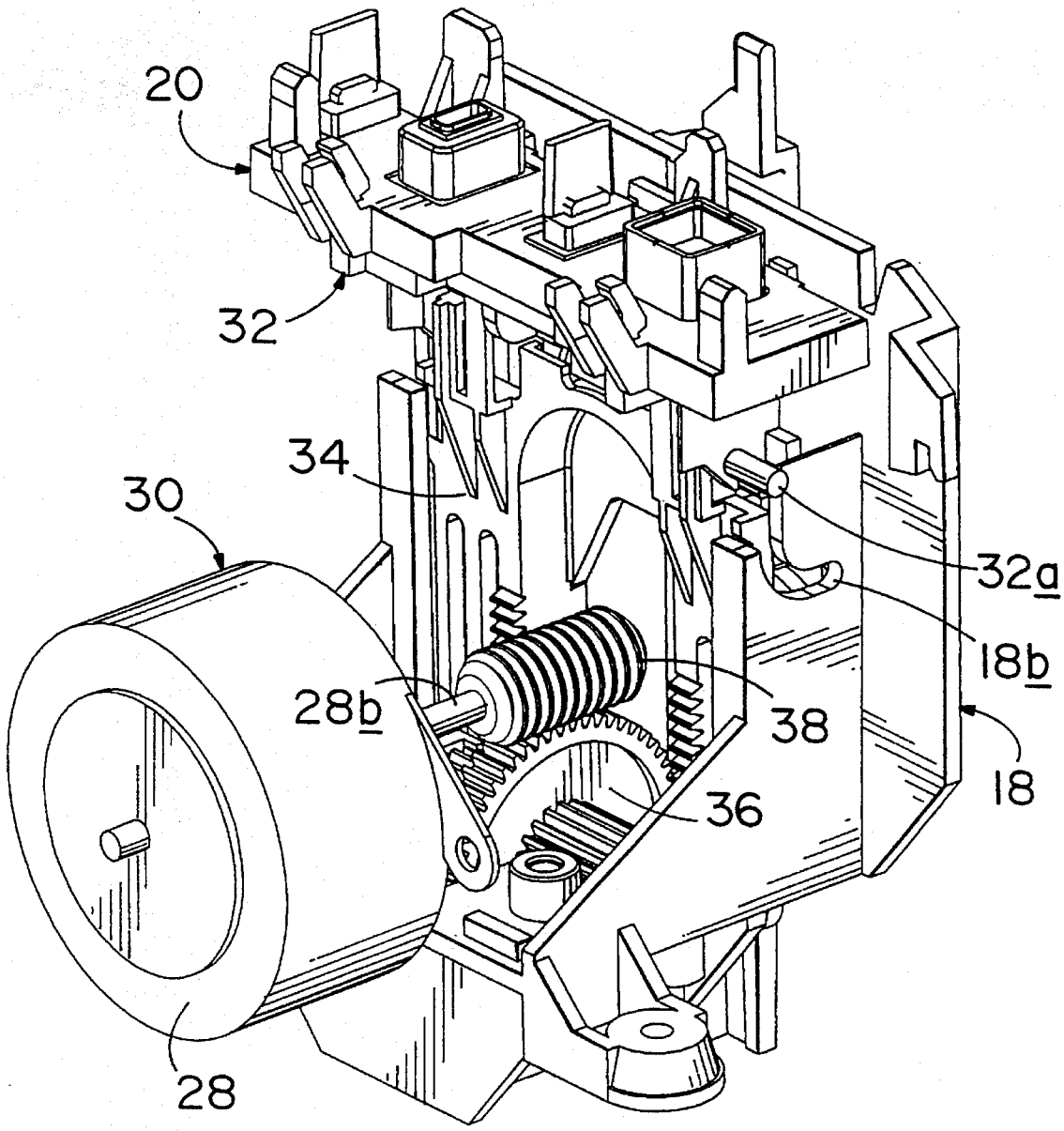
FIG. 3 shows the service station of FIG. 2 with several components removed better to expose the station's drive system.
Figure 4:
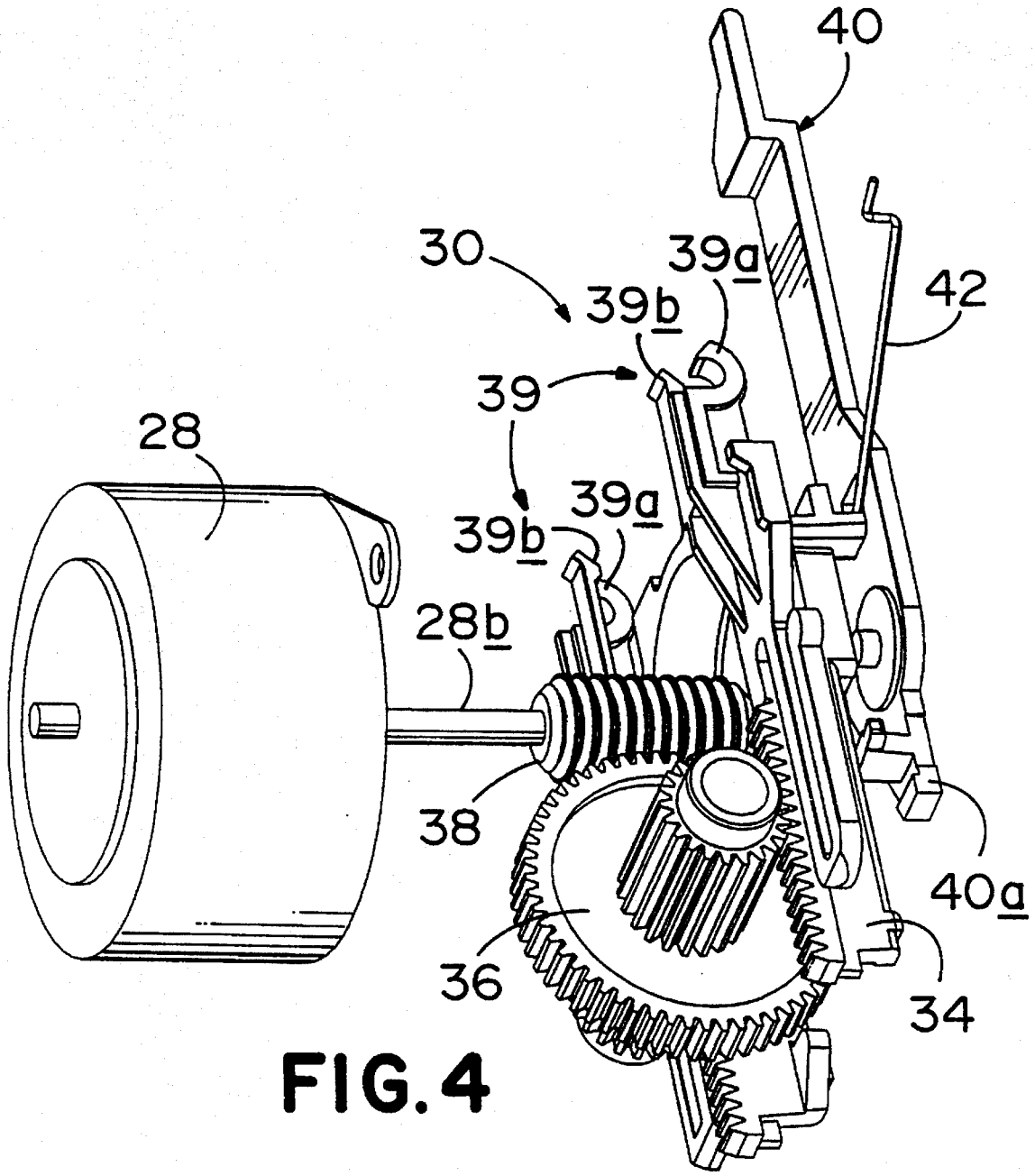
FIG. 4 shows the drive system of FIG. 3 in isolation.

Sled movement is effected by operation of a unique drive system 30, such system being partially obscured by motor housing structure 28*a* in FIG. 2, but shown in detail in FIGS. 3 and 4. Although employed for illustrative purposes in this disclosure as being employed in a printer service station, it is to be understood that such drive system is also suitable for use in various other devices which may or may not be related to printers. Such alternative drive system applications may, for example, include use in conveyors or any other devices where it is desirable to temporarily stall device operation. The drive system is operatively coupled with sled 20 via a clamping member 32, such member providing unique structure by which the sled is made readily removable. A more complete discussion of clamping member, however, has been delayed until such time as the description of the drive system has been completed.

Focusing attention now on the drive system, and referring specifically to FIGS. 3 and 4, wherein the system is best shown, the reader will note that such system includes a drive train which selectively is driven by mechanism such as motor 28. As indicated, the drive train includes a rack 34 and a pinion gear 36 which together form a rack-and-pinion mechanism for conversion of rotational pinion movement into translational rack movement. The rack carries instrumentality such as the sled and the servicing mechanism to effect corresponding movement thereof. The drive train also includes a worm gear 38, such worm gear acting on the pinion gear to effect rotation thereof. All three drive train components are operatively driven by motor 28, but the worm gear is most directly connected to the motor via motor shaft 28*b*. As will be recognized by those skilled in the art, motor 28 may be of virtually any conventional design, but is preferably a stepper motor so that instrumentality such as the sled may readily be moved incrementally in the manner which will now be described.

Beginning with a review of the relationship between worm gear 38 and pinion gear 36, it will be noted that such worm gear includes a helical ridge which operates on the teeth of a central sprocket on pinion gear 36 to effect rotation thereof. A pair of smaller sprockets, which are linked to the central sprocket, correspondingly are turned, engaging the rack so as to effect translation thereof. In this manner, the worm gear is operatively coupled with the rack via the pinion gear. Upon worm gear rotation, the rack is translated, and upon worm gear lock the rack is locked. In the depicted embodiment, wherein motor 28 is coupled to the worm gear to effect drive thereof, the motor is similarly used to lock the rack in place by shutting the motor down. Where, as is preferred, the motor is a stepper motor, the track may be locked in place after each motor step. In the present service station embodiment, drive system locking is particularly beneficial when the printheads are capped so as to ensure maintenance of a proper seal.

Figure 5A:
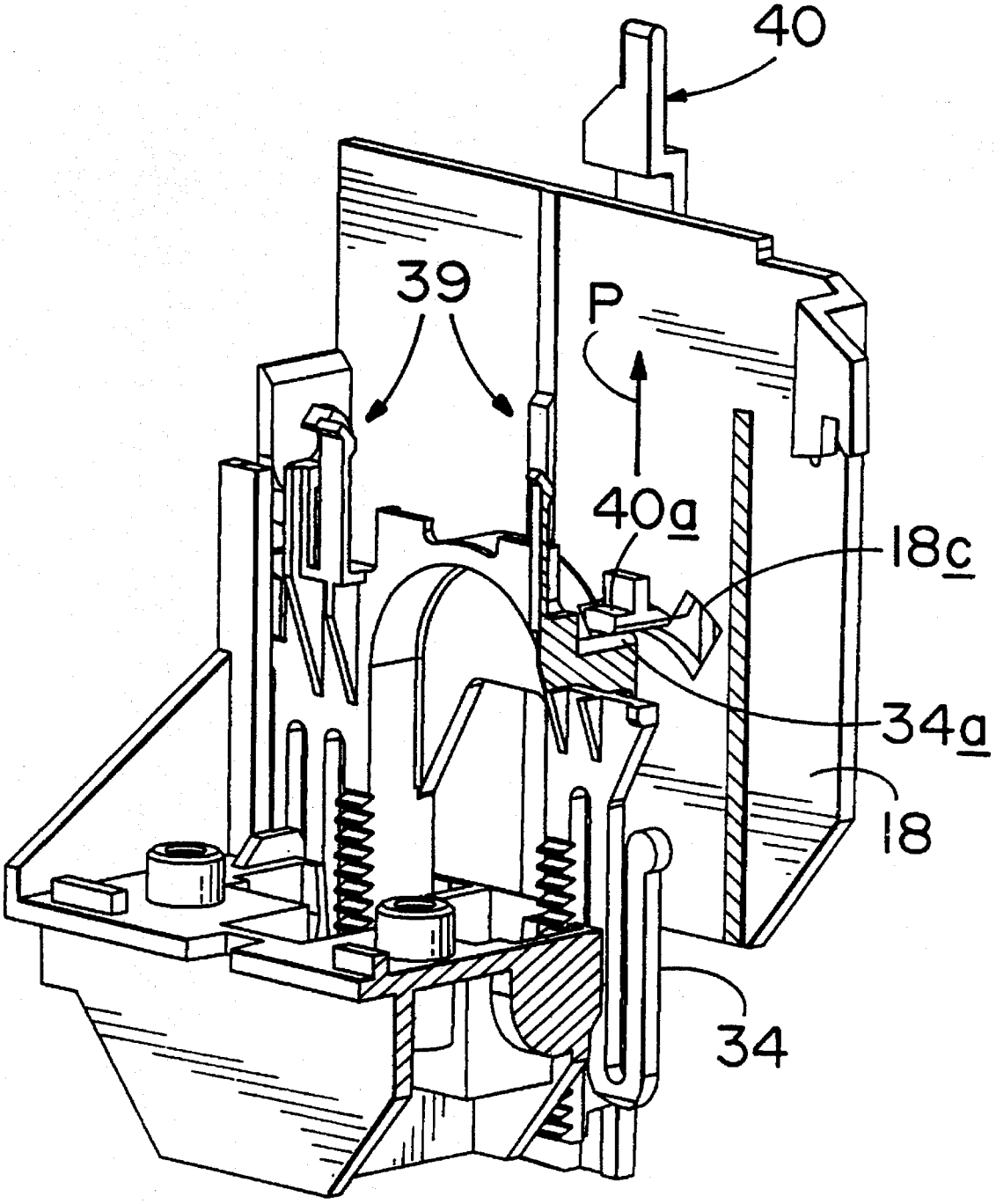
FIGS. 5A and 5B illustrate operation of the drive system shown in FIG. 3, such view having been simplified so as to expose mechanism by which the drive system is stalled.
Figure 5B:
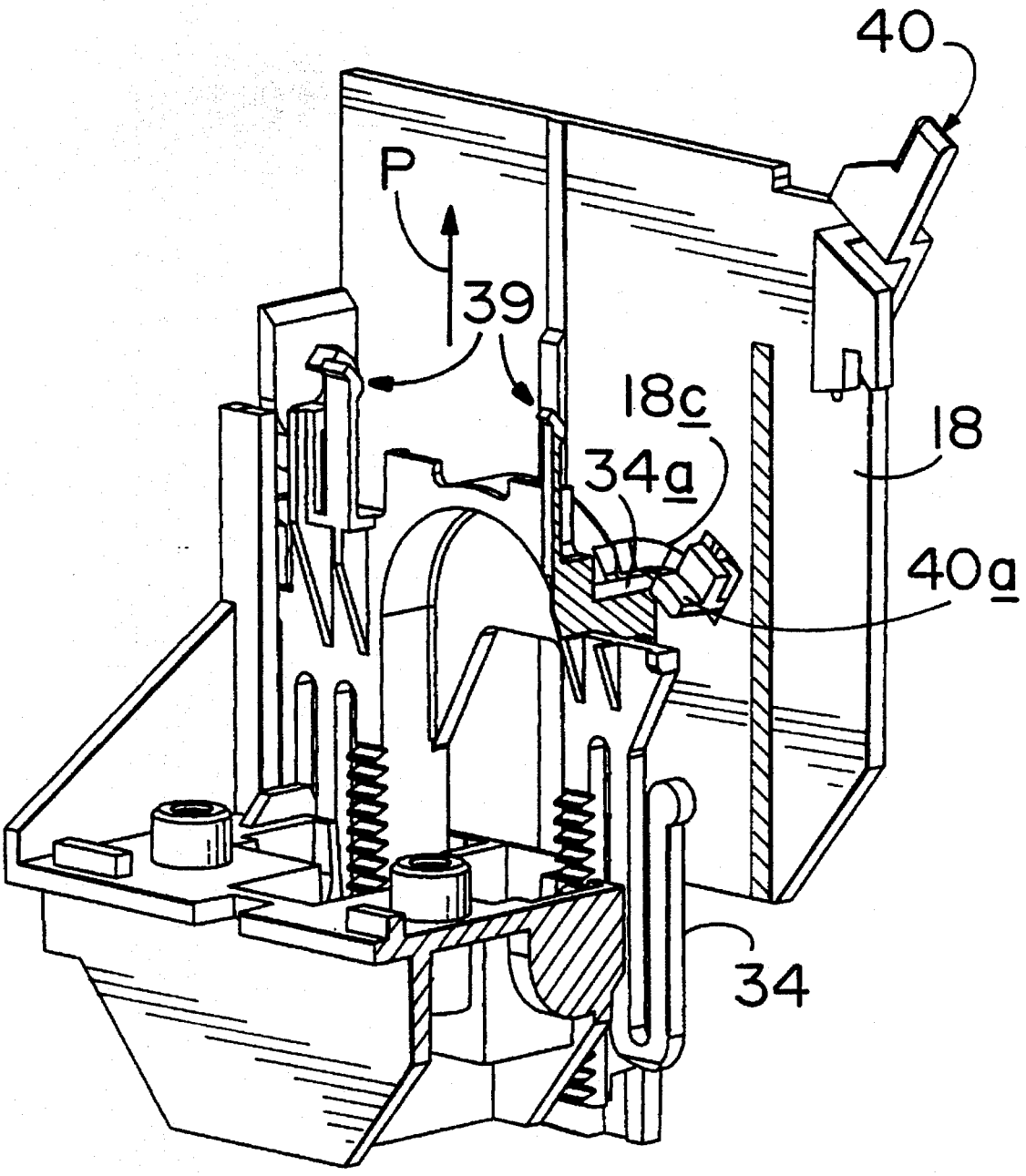
Figure 6A:
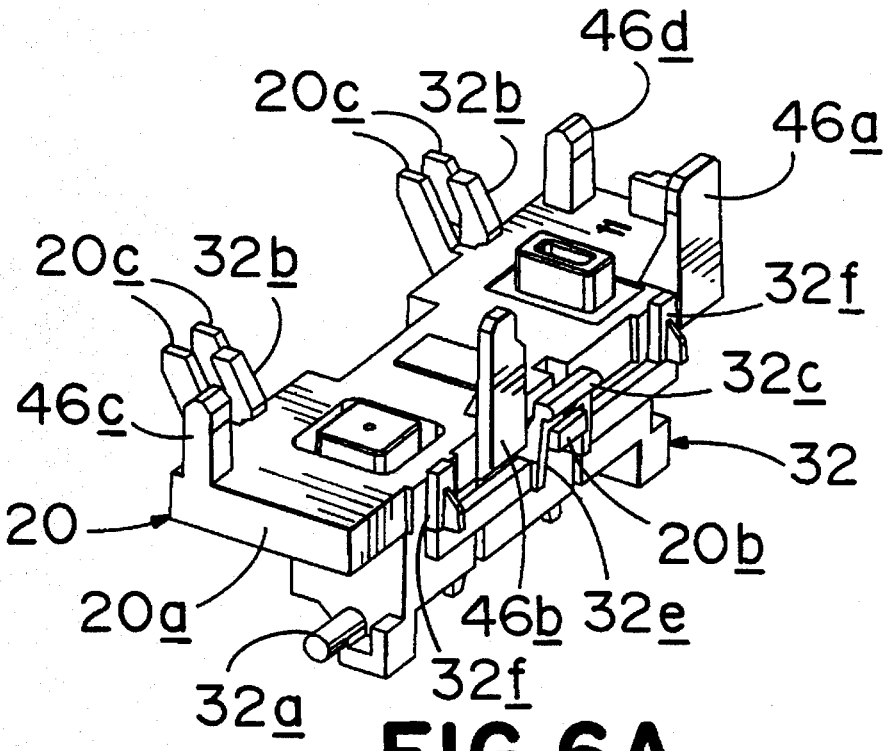
FIGS. 6A through 6D show a sled/clamp combination which form a part of the service station of FIG. 2, disassociation of the sled and clamp being illustrated.
Figure 6B:
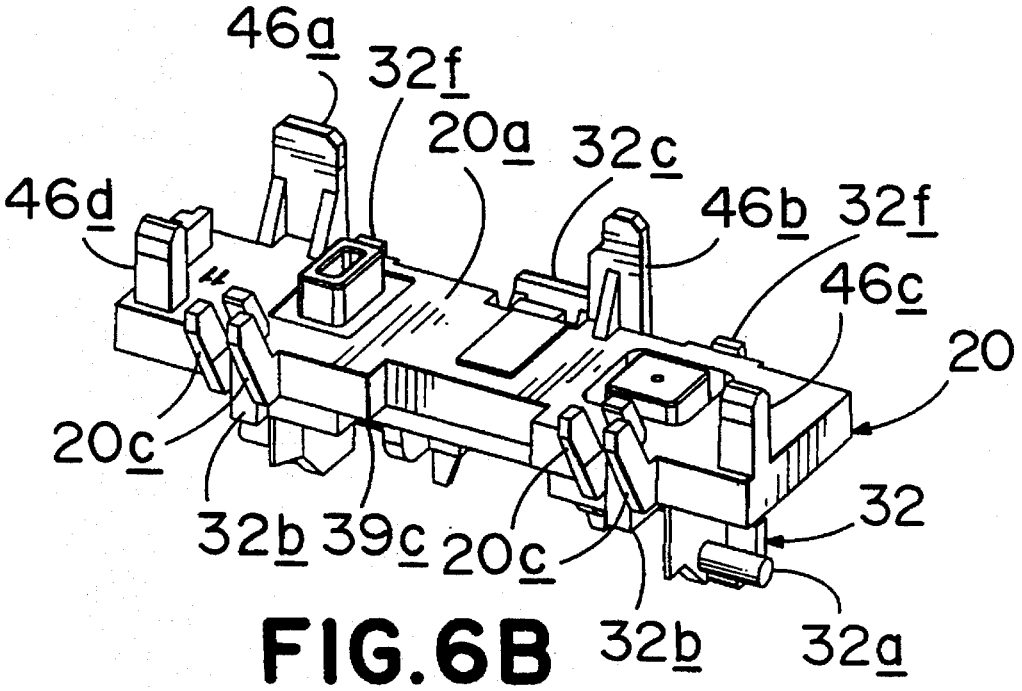

As best shown in FIG. 3, but as also shown in FIGS. 4, 5A and 5B, rack 34 is captured by a pair of facing grooves in the service station flamework so as to promote controlled reciprocal vertical translation of the rack relative to the flamework and thus relative to the printer's chassis. The rack has a pair of hinges 39, each formed by cooperating hook and latch members 39*a* and 39*b*, which rotatably grip a pair of pivot pins, such as pin 39*c* (see FIG. 6B), located along the underside of the clamping member 32. The clamping member fixedly grips sled 20, so as to effect reciprocal transport of the sled by the rack. The clamp/sled combination follow a track which is defined by cammed engagement between the clamp and the flamework, the clamp including a pair of pins 32*a*, which follow a pair of corresponding flamework slots one of which is shown at 18*b*. Such slot, it will be appreciated, effects pivot of the clamp/sled combination about a pivot axis defined by clamp pins 39*c* as pins 39*c* pivot within the rack hook and latch members 39*a* and 39*b* during a first portion of the rack's reciprocation cycle (during pin movement horizontally through the slot) The pivot axis defined by pins 39*c* moves vertically with respect to the service station framework and printer chassis as the rack 34 moves vertically. Travel of the clamp pins 32*a* within the horizontal portion of the framework slot 18*b* while the rack 34 continues to move vertically causes the pivotal motion of the clamp/sled combination with respect to the rack 34 as the clamp pins 39*c* pivot within the grip of the hook and latch members 39*a* and 39*b* of rack 34. The slot 18*b* also effects linear, vertical translation during a second portion of the rack's reciprocation cycle (during pin movement vertically through the slot and beyond). Vertical clamp/sled movement is thus generally effected during printhead capping and wiping, and pivotal clamp/sled movement is generally effected during wiper scraping.

Another important feature of the drive system 30 concerns its ability to effect momentary stall of the rack without bringing about jamming of the worm or pinion gears. Such feature will be most readily understood upon reference to FIGS. 5A and 5B. Rack stall is achieved by the provision of a movable stop such as that provided by end 40*a* of lever 40 in FIG. 5A. As indicated, when the lever is in a first position (shown in FIG. 5A), end 40*a* is in a corresponding first position so as to limit movement of the rack in a first direction P. Such limitation is effected by engagement between lever end 40*a* and rack 34 in a contact area 34*a*. End 40*a*, it will be understood, is put into such contact by its extension through an aperture 18*c* in framework 18. The rack, which is directed to move in a first vertical direction P, engages end 40*a* and thus restricts further movement of the rack in direction P. Because the rack is motor driven, and because the drive train between the rack and the motor include interengaging mechanism such as gear teeth (and a helical ridge on the worm gear), torque will build up in the pinion gear and the worm gear so as to cause drive train jamming. At this point, the drive system may be unjammed, and the rack allowed to continue along its path in direction P by action of the lever so as to move end 40*a* out of the rack's path. Such second lever position, as best illustrated in FIG. 5B, allows passage of end 40*a* through aperture 18*c* into a second position which allows passage of the rack in the direction P and alleviates torque previously built up in the gear train.

In the preferred embodiment, the lever is biased to the first position, placing end 40*a* in a position such that the rack will contact the same so as to stall the rack in that position. Such bias, as best shown in FIG. 4, is caused by action of a torsion spring 42. To move the lever from its first position to its second position, a processor controlled actuator is employed. Such actuator may take varied forms, but is preferably the printer's printhead carriage, such carriage 14 selectively engaging the lever as it passes into a printhead-servicing position as described above.

Upon system start up, the rack is raised to engage the stop, driving the worm gear in a wedged orientation relative to the pinion gear, resulting in torque build-up, and to eventual stall of the stepper motor. The stop is then removed by action of the actuator which engages the lever. This alleviates torque built up in the gears and allows the system to continue in the first direction toward the printheads. Upon stalling of the motor the processor may be directed to record the position of the rack, defining such position as the reference against which movements are thereafter measured.

As alluded to above, service station 16 is made further adaptable and more easily repairable by inclusion of a feature which allows for quick release of sled 20, and thus quick release of the printhead servicing mechanism secured thereto. Such feature is best shown in FIGS. 6A–6D, which show the sled secured to clamp 32 in FIGS. 6A and 6B, and then show release of the sled by a pinching action represented generally by force arrows Fa and Fb.

Upon reference to the drawings, it will be noted that the sled is generally held tightly by the clamping member using a pair of elongate, rigid clamp fingers 32*b* and a pair of elongate, resilient members 32*f*. The clamp fingers extend upwardly from the clamp's base in a forward region (from the user's perspective looking into the printer) and the resilient members extend upwardly from the clamp's base in a rearward region (again from the user's perspective looking into the printer). The fingers and resilient members are adequately spaced so as to accommodate secure capture of the sled therebetween. Specifically, the fingers and resilient members bear on the sled's base 20*a*, the resilient members urging the sled into engagement with the clamp fingers as shown. In order to ensure a properly oriented combination, the fingers are formed with a ridge 32*d* (best shown in FIG. 6D) which engages the sled's base. The clamp may also be formed with a protuberance 32*c* which is formed with an aperture 32*e* through which a lateral hinge member 20*b* extends.

The sled, which is specially designed to allow ready gripping and quick removal thereof, includes a series of elongate projections 20*c* which extend angularly upwardly from the sled's body. These projections, it will be appreciated, are arranged in pairs with the projections of each such pair extending from adjacent opposite sides of a corresponding finger when the sled and clamp are combined. The clamp fingers are provided with comfort-enhancing features such as surfaces which are at an angle similar to that of the sled's projections so as to promote easy sled removal as will now be described.

Figure 6C:
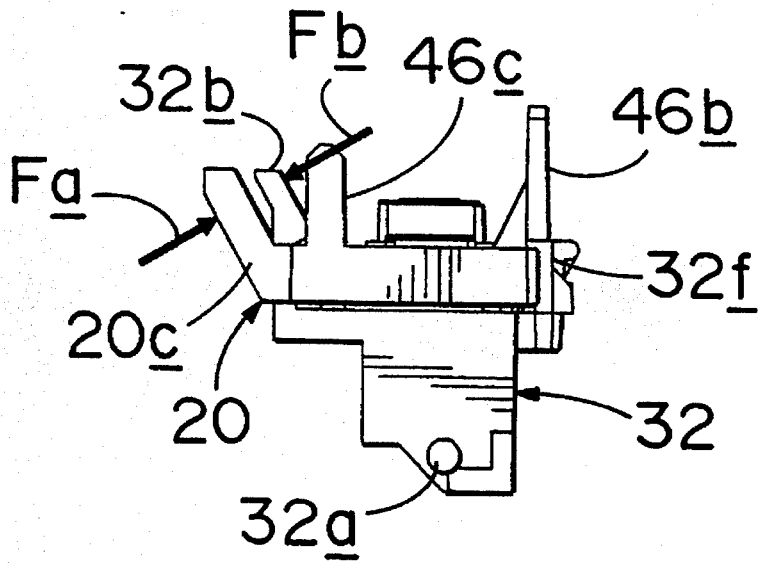
Figure 6D:
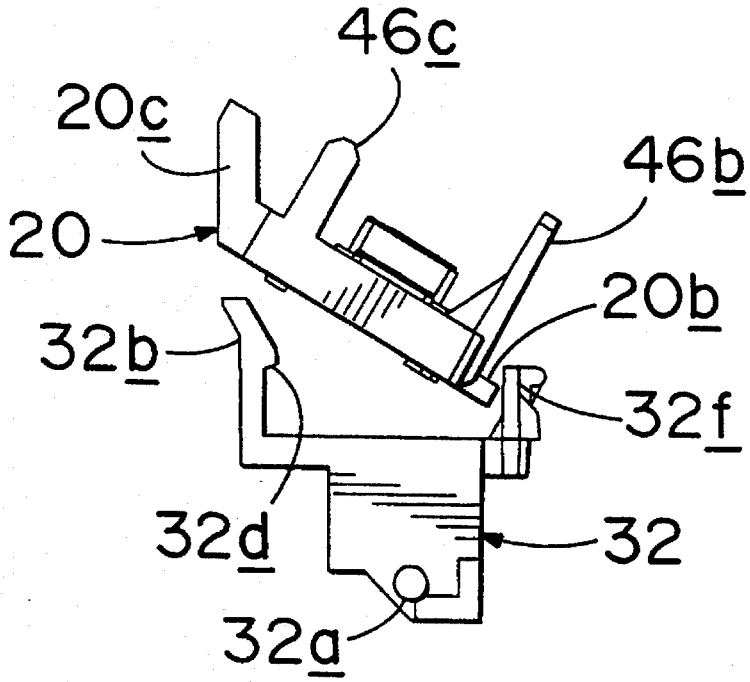

To remove the sled from the clamp, the printer's operator simply pinches the sled projections toward the corresponding clamp finger as indicated by force arrows Fa and Fb in FIG. 6C. The sled moves back against the resilient members 32*e*, deflecting them rearwardly. Ridge 32*d* is thus removed from engagement with the sled body and the sled is allowed to pivot out of the clamp about hinge member 20*b* as shown in FIG. 6D. Because of the angulation of the sled projections, the above-described pinching action effects generally biased pivot about the sled's rear edge. The projections, in such an arrangement may be used as handle or grip means by which the sled is held, a feature particularly beneficial when replacing sleds used in ink-jet printers inasmuch as their bases may have ink on them. This arrangement also serves to take the relatively fragile resilient members away from the operator to protect them from inadvertent harm. A tight, no-slop, releasable coupling of the sled (and thus the servicing mechanism) to the clamp is thus provided.

Figure 7:
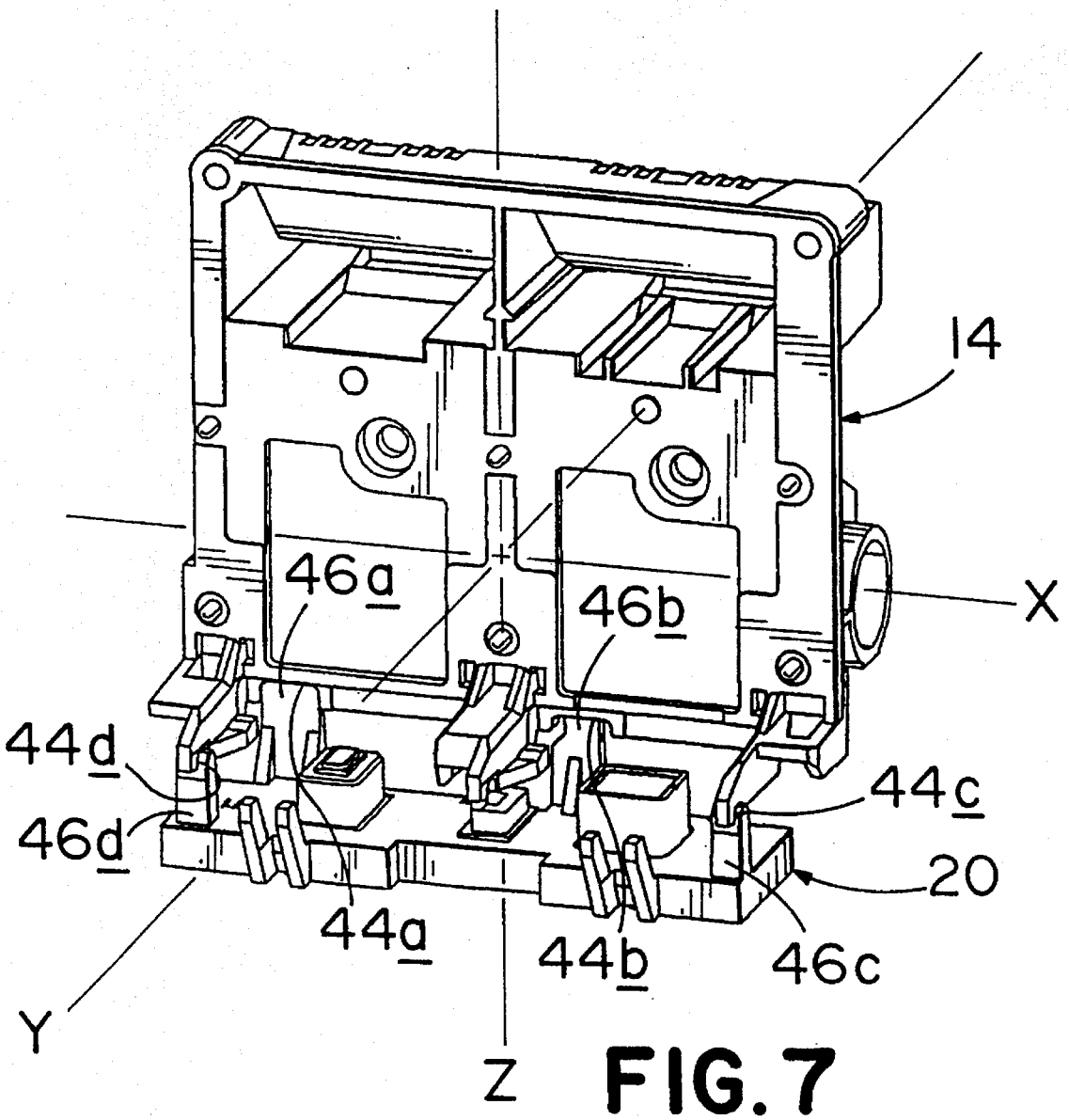
FIG. 7 shows the improved service station wherein the station's sled has been registered in the printer's printhead carriage.

Another unique feature of the improved service station disclosed herein relates to its printhead registration system. Such system, it will be appreciated is particularly useful in the capping of printheads, an operation which requires a precise and stable relationship between the printheads and the printhead caps which are mounted on the sled. The registration system employed is illustrated in FIG. 7, wherein the service station's sled 20 is registered in printhead carriage 14 (which rigidly holds the printheads as described above). Such registration is selectively effected upon vertical movement of the sled into a defined engagement with the carriage as when such carriage is in a servicing position for printhead capping.

In order to equip the printer with the ability to effect proper registration, the carriage is defined so as to have a plurality of spaced detents 44*a*–44*d*, each such detent being positioned so that it will be engaged by a corresponding sled post 46*a*–46*d* upon movement of the sled vertically into engagement therewith as described above. As indicated, vertical movement of the sled brings about combination of the posts and detents so as to effect restriction of relative rotation or translation between the two components about mutually-perpendicular X, Y, and Z axes. Although four posts are used, those skilled in the art will recognize that the desired registration may be accomplished using only three such posts.

In the embodiment shown, post 46*a*, by its engagement with detent 44*a* effects restriction of relative sled/carriage movement along the X axis. Engagement of post 46*b* with detent 44*b* effects a limit of continued vertical movement along the Z axis in the direction of relative approach. Posts 46*c* and 46*d* restrict movement along the Y axis and aid in restricting movement in the Z direction just described. All four of the posts cooperate to restrict rotation about each of the X, Y and Z axes by virtue of their spaced orientation relative one another.

INDUSTRIAL APPLICABILITY

It should thus be apparent that the invented methodology and apparatus solves the various problems related to the alignment, carriage and replacement of instrumentality, particularly with respect to mechanism used in the servicing of printheads. The solutions are suitable for use in a broad array of devices including various printers inasmuch as it is embodied in a modular service station arrangement which mounts servicing mechanism on a removable sled. To adapt the station for use on another printer or to repair or replace damaged or worn servicing mechanism, the user need only remove one sled and replace it with another sled which carries the desired mechanism. The drive system, which allows for improved carrying and alignment operations, is of the broadest industrial applicability, being suitable for use in virtually any device where it is desirable to temporarily stall device operation. Herein, however, such system forms a part of the improved service station and is readily removable therewith.

While the present invention has been disclosed with reference to the foregoing operation principles and the preferred embodiment shown in the drawings and described above, it will be apparent to those skilled in the art that changes in form and detail may be made therein without departing from the spirit and scope of the invention as it is defined by the appended claims.

We claim:

1. A printing apparatus, comprising:

a reference structure:

a printhead mounted for controlled reciprocal movement relative to the reference structure;

an instrumentality; and a drive system mounted relative to the reference structure for use in effecting controlled movement of the instrumentality relative to the reference structure, the drive system comprising;

a rack mounted relative to the reference structure for movement in a first direction;

a driven pinion gear operatively coupled with said rack to effect movement thereof in said first direction; and a stop controllably movable from a first position to a second position in response to the movement of the printhead, wherein at the first position, the stop limits movement of said rack in the first direction to locate the rack at a home position, and wherein at the second position, the stop allows further movement of said rack in said first direction, with the home position of the rack providing a reference for said further movement of the rack.

2. The apparatus of claim 1, wherein said stop, when in said first position, limits movement of said rack by passage of the same into operative engagement with said stop.

3. The apparatus of claim 1, wherein said stop is yieldably biased toward said first position.

4. The apparatus of claim 10 further comprising a printhead carriage that mounts the printhead to the reference structure, wherein the printhead carriage is configured to selectively move said stop from said first position to said second position.

5. The apparatus of claim 4 wherein said printhead carriage is processor controlled.

6. The apparatus of claim 4 wherein the drive system further comprises a worm gear coupled to drive the pinion gear.

7. The apparatus of claim 1 further comprising a worm gear operatively coupled with said pinion gear for driving the same.

8. The apparatus of claim 7, wherein said worm gear is motor-driven.

9. The apparatus of claim 7, wherein said worm gear is driven into wedged orientation when said stop is in said first position, said worm gear being released upon movement of said stop into said second position.

10. The apparatus of claim 7, wherein said worm gear is processor-controlled.

11. The apparatus of claim 7, wherein said worm gear is effective selectively to lock said rack in place.

12. A printing apparatus according to claim 1, wherein the reference structure comprises a chassis of an inkjet printing mechanism having a printhead, and the instrumentality comprises a service station which services the printhead.

13. A printing apparatus according to claim 12, wherein the service station further includes a framework configured for selected removable securement to the chassis such that removal of the framework from the chassis effects removal of the service station therewith.

14. A printing apparatus according to claim 13, wherein:

the service station further includes a sled with a base and a projection which extends angularly upward from the sled; and the framework includes a clamping member configured to selectively capture the sled, the clamping member including an upwardly extending finger and an upwardly extending resilient member spaced from the finger to allow removable capture of the sled therebetween, with the finger being positioned, upon sled capture, to extend adjacent the projection to accommodate deflection of the resilient member by pinching action against the projection and the finger so as to release the sled from capture.

15. A printing apparatus according to claim 12, wherein:

the inkjet printing mechanism includes a horizontally movable carriage which carries the printhead, with the carriage defining a plurality of spaced dents therein; and the service station further includes a vertically movable sled having a plurality of spaced posts configured for combination with the carriage dents, with the combined dents and posts located to restrict relative rotation of the carriage and sled about a vertical axis.

16. A printing apparatus according to claim 12, wherein:

the inkjet printing mechanism includes a horizontally movable carriage which carries the printhead, with the carriage defining a plurality of spaced dents therein;

the service station further includes a vertically movable sled with a base and a projection which extends angularly upward from the sled, the sled also having a plurality of spaced posts configured for combination with the carriage dents, with the combined dents and posts located to restrict relative rotation of the carriage and sled about a vertical axis, with the service station also having a framework configured for selected removable securement to the chassis such that removal of the framework from the chassis effects removal of the service station therewith; and the framework includes a clamping member configured to selectively capture the sled, the clamping member including an upwardly extending finger and an upwardly extending resilient member spaced from the finger to allow removable capture of the sled therebetween, with the finger being positioned, upon sled capture, to extend adjacent the projection to accommodate deflection of the resilient member by pinching action against the projection and the finger so as to release the sled from capture.

17. A printing apparatus, comprising:

a reference structure comprising a chassis of an inkjet printing mechanism;

an instrumentality including a framework configured for selected removable securement to the chassis, and a sled with a base and a projection which extends angularly upward from the sled, wherein the framework includes a clamping member configured to selectively capture the sled, the damping member including an upwardly extending finger and an upwardly extending resilient member spaced from the finger to allow removable capture of the sled therebetween., with the finger being positioned, upon sled capture, to extend adjacent the projection to accommodate deflection of the resilient member by pinching action against the projection and the finger so as to release the sled from capture; and a drive system mounted relative to the reference structure for use in effecting controlled movement of the instrumentality relative to the reference structure, the drive system comprising:

a rack-and-pinion mechanism including an instrumentality-carrying rack and a rotating pinion gear, said pinion gear being mounted to effect translation of said rack relative to the reference structure; and a worm gear operatively coupled with said rack via said pinion gear selectively to lock said rack in place.

18. The apparatus of claim 17 further comprising a motor coupled with said worm gear selectively to drive the same.

19. The apparatus of claim 18, wherein said motor is a stepper motor, said rack being lockable after each motor step.

20. A printing apparatus according to claim 17, wherein the inkjet printing mechanism includes a printhead, and the instrumentality comprises a service station which services the printhead.

21. A printing apparatus according to claim 20, wherein the service station comprises said framework such that removal of the framework from the chassis effects removal of the service station therewith.

22. A printing apparatus according to claim 20, wherein: the inkjet printing mechanism includes a horizontally movable carriage which carries the printhead, with the carriage defining a plurality of spaced dents therein; and the sled is vertically movable and has a plurality of spaced posts configured for combination with the carriage dents, with the combined dents and posts located to restrict relative rotation of the carriage and sled about a vertical axis.

23. A printing apparatus according to claim 20, wherein:

the inkjet printing mechanism includes a horizontally movable carriage which carries the printhead; and the drive system further comprises a stop controllably movable from a first position to a second position in response to the movement of the printhead, wherein at the first position, the stop limits movement of said rack in a first direction to locate the rack at a home position, and wherein at the second position, the stop allows further movement of said rack in said first direction, with the home position of the rack providing a reference for said further movement of the rack.

24. A method for use in preventing gear-jam in a drive system of a printing apparatus which employs a worm gear, and a rack and pinion gear, said method comprising the steps of:

driving the pinion gear with the worm gear to rotate the pinion gear against the rack to translate the rack in a first direction along a predetermined rack path;

halting translation of the rack by effecting contact thereof against a movable stop positioned in the rack's path;

in response to the halting stem driving the worm gear into a wedged orientation relative to the pinion gear which builds-up torque between the worm gear and the pinion gear;

removing the stop from the rack's path to alleviate the built-up torque between the worm gear and the pinion gear; and after the removing step continuing translation of the rack in the first direction along the rack's path.

25. The method of claim 24 which further comprises positioning of the stop selectively in the rack's path in time to effect contact of the rack against the stop to halt translation of the rack.

26. The method of claim 24, wherein said removing of the stop is processor controlled.

27. The method of claim 24, wherein:

the printing apparatus comprises an inkjet printing mechanism having a chassis, a printhead reciprocally movable with respect to the chassis, and a printhead service station;

the removing step comprises removing the stop from the rack's path during a portion of the reciprocal movement of the printhead; and the method further includes the steps of mounting the service station to the chassis using the rack and pinion gear, and following the continuing translation step, selectively servicing the printhead by driving the pinion gear with the worm gear to rotate the pinion gear against the rack to move the service station into engagement with the printhead.

28. The method of claim 27, wherein;

the printhead is selectively moveable into various printhead-servicing positions such that corresponding servicing tasks may be executed by the service station; and the method further includes the steps of:

identifying the desired servicing task;

identifying the desired printhead-servicing position execution of the identified servicing task;

moving the printhead horizontally to the identified printhead-servicing position; and executing the identified servicing task.

* * * * *